US006418942B1

(12) United States Patent
Gray et al.

(10) Patent No.: US 6,418,942 B1
(45) Date of Patent: Jul. 16, 2002

(54) SOLVENT AND AQUEOUS DECOMPRESSION PROCESSING SYSTEM

(76) Inventors: Donald Gray, 9 McGraw Ct., Warwick, RI (US) 02818; Charlotte Frederick, 1443 E. LaVieve La., Tempe, AZ (US) 85284

( * ) Notice: Subject to any disclaimer, the term of this patent is extended or adjusted under 35 U.S.C. 154(b) by 0 days.

(21) Appl. No.: 09/522,587

(22) Filed: Mar. 10, 2000

(51) Int. Cl.[7] ..... B08B 5/00

(52) U.S. Cl. ..... 134/1.3; 134/10; 134/11; 134/21; 134/22.12

(58) Field of Search ..... 134/1.3, 10, 11, 134/21, 22.1, 22.12, 25.4

(56) References Cited

U.S. PATENT DOCUMENTS

| | | | | |
|---|---|---|---|---|
| 5,268,036 A | * | 12/1993 | Neubauer et al. | 134/2 |
| 5,370,740 A | * | 12/1994 | Chao et al. | 134/1 |
| 5,456,759 A | * | 10/1995 | Stanford, Jr. et al. | 134/1 |
| 5,800,626 A | * | 9/1998 | Cohen et al. | 134/1.3 |
| 5,810,037 A | * | 9/1998 | Sasaki et al. | 134/111 |
| 5,849,091 A | * | 12/1998 | Skrovan et al. | 134/1 |
| 6,006,765 A | * | 12/1999 | Skrovan et al. | 134/1.3 |

FOREIGN PATENT DOCUMENTS

| | | | | |
|---|---|---|---|---|
| SU | 1600857 A | * | 10/1990 | B08B/3/04 |

* cited by examiner

*Primary Examiner*—Randy Gulakowski
*Assistant Examiner*—J Smetana
(74) *Attorney, Agent, or Firm*—Barlow, Josephs & Holmes, Ltd.

(57) ABSTRACT

An enclosed solvent and aqueous decompression processing system includes a chamber for holding an object to be processed. At least one vacuum pump applies a negative gauge pressure to the chamber to remove air and other non-condensable gases. Means are provided for introducing a solvent to the evacuated chamber to treat the object contained within. Treatment may be in the form of coating, etching, deposition, cleaning, stripping, plating, adhesion, dissolving, filtering or any other process in which material is removed or deposited on a solid surface by transfer from or to a liquid phase. A first system removes pressure from the chamber to produce vapor bubbles for processing. A second system increases pressure by ceasing to apply vacuum or adding non-condensable gases. The system includes recovery of the solvent from the chamber and object. A method of treating an object in an enclosed solvent processing system, comprises the steps of: isolating a solvent supply system with respect to the chamber; evacuating the chamber to remove air and other non-condensable gases; isolating the chamber with respect to atmosphere; introducing a solvent into the evacuated chamber; processing the object by cyclically alternating vacuum and pressure in the chamber; recovering the solvent introduced into the chamber; sealing the chamber with respect to the solvent supply system; introducing air into the chamber for sweeping further solvent on the object and within the chamber; and removing the treated object.

11 Claims, 2 Drawing Sheets

Figure 1:
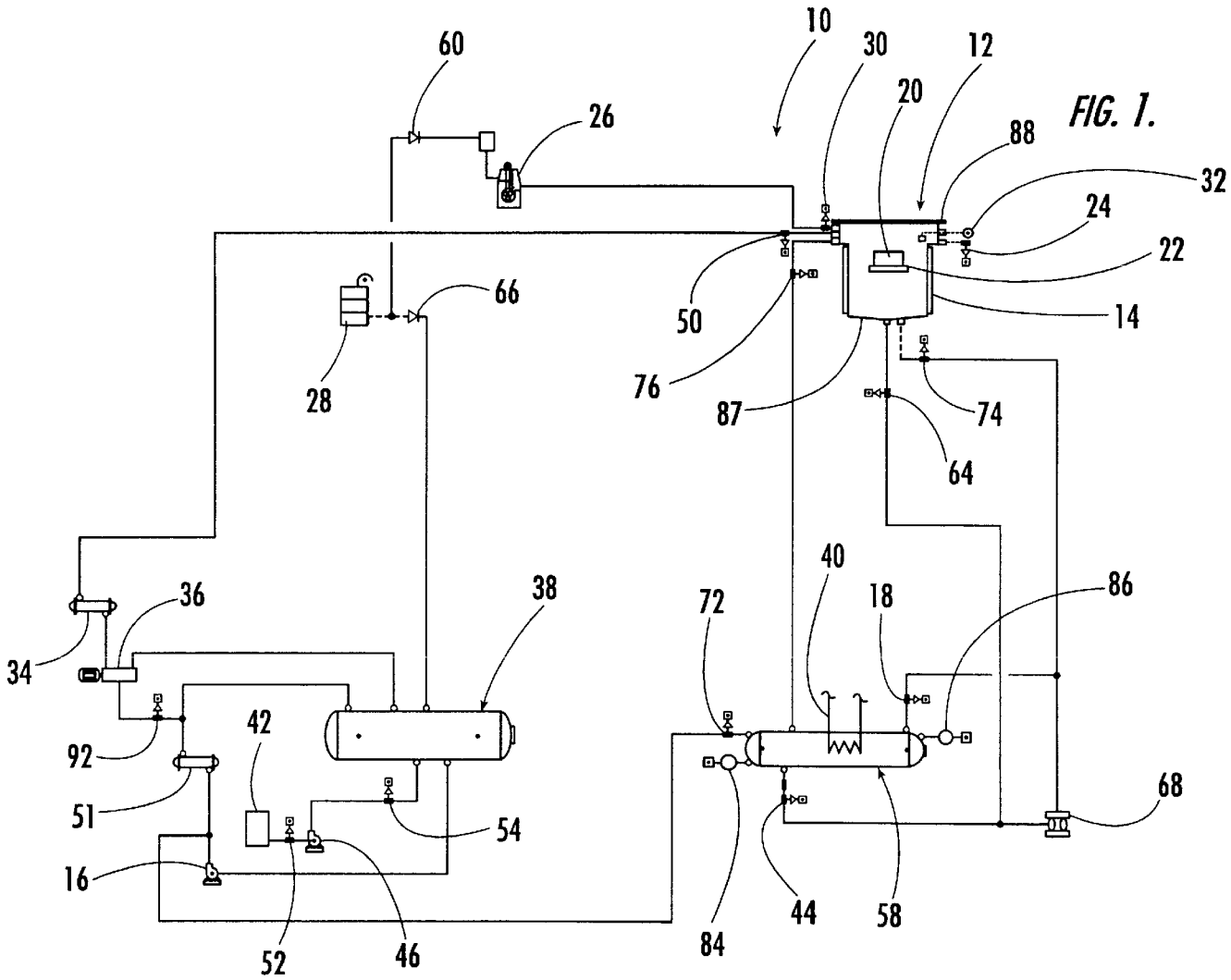

10A
12
16
18
20
22
24
26
28
30
32
34
36
38
44
50
51
58
60
64
66
68
70
72
74
76
78
80
82
84
86
87
88
90
92
94
96

SOLVENT AND AQUEOUS DECOMPRESSION PROCESSING SYSTEM

BACKGROUND AND SUMMARY OF THE INVENTION

The present invention relates to material treatment processes, and more particularly to an enclosed solvent and aqueous decompression processing system that enhances the transfer of material to or from a liquid to a solid surface by producing bubbles at the solid surface and either detaching or collapsing these bubbles in a cyclical manner.

Cavitation is a well-accepted means of cleaning surfaces. An object having a solid surface to be cleaned is immersed in the fluid. Typically, ultrasonic sound waves are used to produce tiny collapsing bubbles at the solid surface. The energy of the ultrasonic waves is released into the fluid and the heat created by this energy evaporates small volumes of the fluid at the surface of the object, forming vapor bubbles. The vapor bubbles are cooled by the surrounding fluid and collapse, releasing their energy on implosion. The strength and aggressiveness of the imploding bubbles can be controlled by controlling the frequency and wavelength of the ultrasonic waves. Low frequency, long wavelength ultrasound produces smaller, less aggressive vapor bubbles that are usually used to cover more surface area and be less erosive to the material being cleaned.

Like ultrasound, decompression processing is the production of vapor bubbles at a solid surface, to produce an energy release at the solid surface. The process is accomplished by alternating vacuum and pressure to produce a pulsing action within a fluid. The release of pressure produces vapor bubbles at the solid surface, which are collapsed when pressure is re-applied. The level of vacuum, and/or pressure, the temperature, rate of introducing vacuum and/or pressure can control the rate of growth and size of the bubbles, and the total energy released.

It would be expected that the size of the bubbles produced with decompression processing can be much greater than that produced by ultrasound. The size and bubble production rate should be similar to that produced in a boiling liquid, which is directly proportional to the rate of heat addition. Since boiling vapor bubbles form at surface crevices and imperfections, it would be expected that decompression bubbles should be very selective by nucleating at particles on the surface thus enhancing particle detachment from the surface, i.e. removal of the particles from the surface (cleaning). If the bubbles are collapsed at the surface, the effect should be like ultrasound in that the imploding bubble would release a large amount of localized energy. On the other hand, if the vapor bubble is allowed to detach from the surface, the particle would be exposed to a reforming boundary layer, and this action should enhance transfer of material to a surface as required in surface coating processes. Unlike ultrasound bubbles which are micron-level in size, and generally smaller than the particles being removed, vapor bubbles formed by decompression would be larger and produce reforming viscous surface layers which can then have an effect on the particles.

These larger bubbles formed during decompression are more selective than ultrasound bubbles by forming at the particle sites, and it is expected that this could produce a targeted energy directed at the solid surface unlike ultrasound waves which release energy directly to the fluid. For sensitive surfaces, or surfaces with crevice particles, decompression indeed provides a more selective, less destructive means for particle removal. In addition, pressure effects of the decompression are omnidirectional throughout the fluid and thus are not shielded from any areas of the solid surfaces. In contrast, ultrasound waves are directional and thus certain surfaces of the solid may be shielded from their effects. Furthermore, since pressure equalizes in all directions, nucleating bubbles can be formed inside tubes just as easy as outside a tube.

The elimination of the fluid boundary layer during decompression may also enhance particle filtration processes especially when micron size particles are present. Generally, it becomes difficult to filter micron size particles from a liquid medium which contains particles which are smaller than 5 microns in diameter. This is because when the liquid is flowing through the filter matrix, the particles tend to follow the fluid streamlines more readily as the particle size is reduced. Micron size particles thus never reach the filter surface to be adsorbed and retained since the fluid velocity goes to zero at the solid filter surface. If the liquid near the filter surface is continuously removed by nucleating vapor bubbles, the micron size particles can now be carried to the surface by the fluid moving in behind the detaching bubble and the particle can now be adsorbed and retained at the surface.

The enhanced diffusion mechanism for particles described above can also be applied to liquid diffusion. For example if it is desired to deliver liquid to a surface for coating or other surface treatment, the evaporation of liquid from the surface can be rapid and the convective effect of the displacement fluid can be orders of magnitude greater than molecular diffusion. This method of diffusion can be more selective than conventional means. For example, in order to deliver an acid to a solid surface for etching, generally a highly concentrated acid solution may be required for performing the task. If a decompression process is used, evaporating bubbles will leave the acid behind creating a highly concentrated acid solution near the surface being treated. The constant flashing of fluid at the surface quickly decreases the pH of the solution used for etching while the surrounding fluid remains relatively high in pH thus not harming the treatment vessel or any other support piping or equipment.

In general, the present invention is directed to an enclosed solvent and aqueous decompression processing system including a chamber for holding an object to be processed. At least one vacuum pump applies a negative gauge pressure to the chamber to remove air and other non-condensable gases. Means are provided for introducing a solvent to the evacuated chamber to treat the object contained within. Treatment may be in the form of coating, etching, deposition, cleaning, stripping, plating, adhesion, dissolving, filtering or any other process in which material is removed or deposited on a solid surface by transfer from or to a liquid phase. A first system removes pressure from the chamber to produce vapor bubbles for processing. A second system increases pressure by ceasing to apply vacuum or adding non-condensable gases. The system includes recovery of the solvent from the chamber and object.

In another aspect of the invention, a method of treating an object in an enclosed solvent decompression processing system, including a solvent supply system in sealable communication with a cleaning chamber comprises the steps of:

(a) sealing the solvent supply system with respect to the chamber;

(b) opening the chamber to atmosphere and placing an object to be treated in the chamber;

(c) evacuating the chamber to remove air and other non-condensable gases;

(d) sealing the chamber with respect to atmosphere;

(e) opening the chamber with respect to the solvent supply system and introducing a solvent into the evacuated chamber;

(f) processing the object by cyclically alternating vacuum and pressure in the chamber;

(g) recovering the solvent introduced into the chamber;

(h) sealing the chamber with respect to the solvent supply system;

(i) introducing air into the chamber for sweeping further solvent on the object and within the chamber; and (j) opening the chamber and removing the treated object.

The main objective of this invention is to enhance the transfer of material to or from a liquid to a solid surface by producing vapor bubbles at the surface and either detaching or collapsing these bubbles in a cyclical manner.

Another object of this invention is to provide an improved closed solvent decompression processing system and method which maintains solvent at a pure solvent vapor state, thus producing a thermodynamic state of a liquid in contact with its' pure vapor. Under such conditions, when the liquid state properties vary only slightly, solvent is vaporized or condensed in a rapid manner. Varying the rates and magnitude of heat addition or removal or pressure increase or reduction in the chamber can control this system and change the characteristics of a process.

Another object of this invention is to provide an improved closed solvent decompression processing system and method which enables solvent recovery and limits hazardous emissions. The invention can employ a variety of solvents having boiling points as low as seventy degrees Fahrenheit and as high as 500 degrees Fahrenheit.

Other objects, features, and advantages will occur to those skilled in the art from the following description of a preferred embodiment and the accompanying drawings.

BRIEF DESCRIPTION OF THE DRAWING FIGURES

Figure 2:
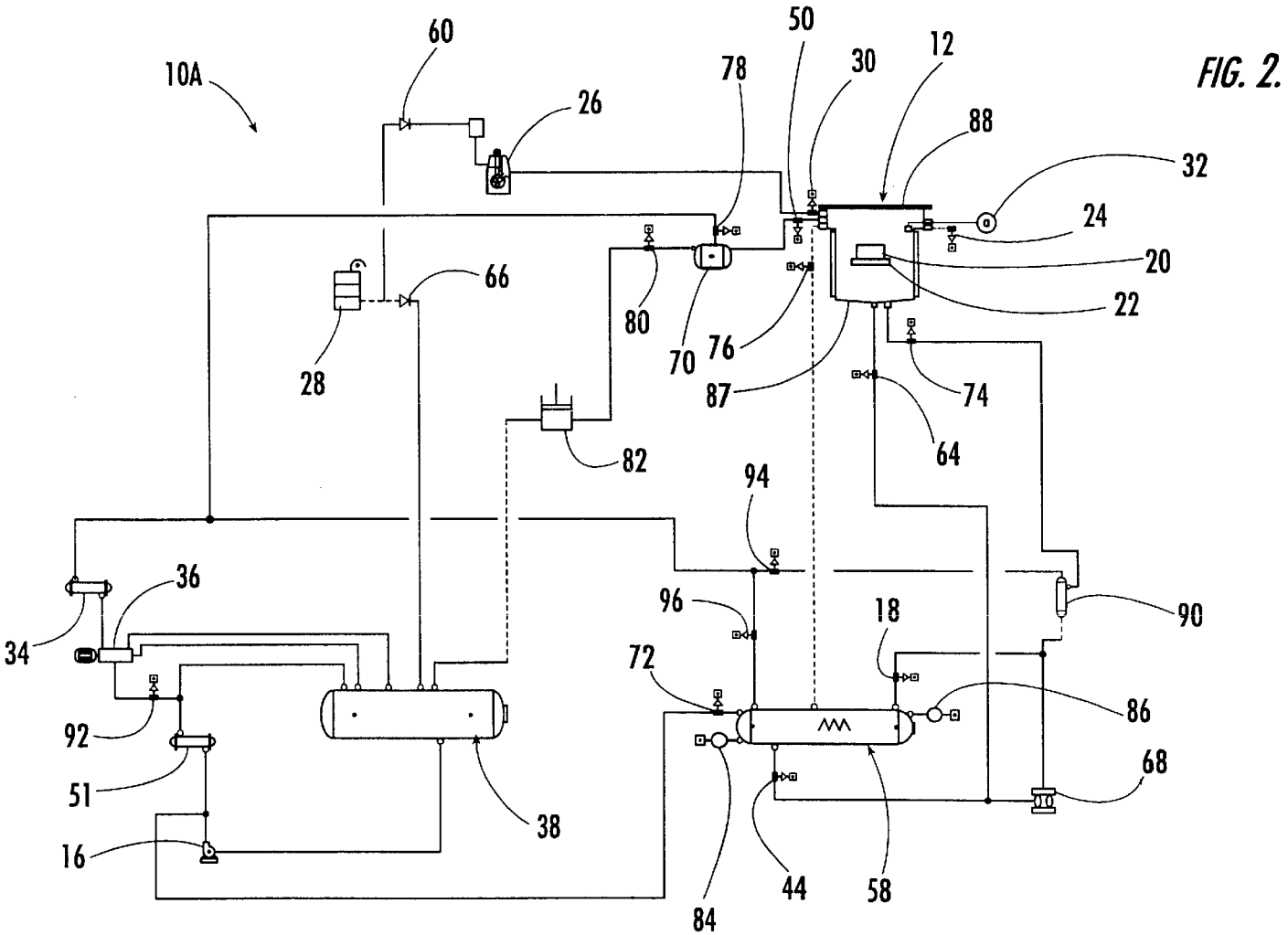

In the drawings which illustrate the best mode presently contemplated for carrying out the present invention:

FIG. 1 is a schematic illustration of the closed solvent processing system of the present invention; and FIG. 2 is a schematic illustration of a second embodiment of the system.

DETAILED DESCRIPTION OF PREFERRED EMBODIMENT

Referring now to the drawings, the solvent and aqueous decompression processing system of the present invention is illustrated and generally indicated at 10 in FIG. 1. In FIG. 1, the system 10 for implementing the teachings of this invention includes a main decompression chamber generally indicated at 12 which may or may not be heated. The main decompression chamber 12 includes a main body portion 87 and a lid 88. In the preferred embodiment, the main body portion 87 of the decompression chamber 12 has an electric heat blanket 14. Other options for heating the chamber 12 include steam, or other heat transfer fluids, such as oil or hot water in an external jacket, plate coils or external pipe welded or soldered to the chamber. The system 10 further includes a solvent source generally indicated at 42, a solvent holding tank generally indicated at 38, and a heated solvent vessel generally indicated at 58. Other component parts of the system 10 will be described in connection with operation thereof.

On startup of the process, the solvent holding tank 38 is charged with a preferred processing solvent or aqueous solution by a conventional charging mechanism, such as the pumping arrangement as depicted in FIG. 1. The charging mechanism as shown includes connecting valves 52 and 54 and an activating pump 46. The solvent holding vessel 38 is charged by opening valves 54 and 52, and activating pump 46 to fill the solvent holding tank 38 to a volume needed to charge the complete system. The air displaced from the holding tank passes through check valve 66, and a carbon filter 28 to prevent any air pollution discharge to the environment.

Upon filling the solvent holding tank 38, the heated solvent vessel 58 is evacuated by first sealing the cleaning chamber 12 by closing lid 88, closing valve 24, opening valves 74, 18 and 30 and activating an air handling (vacuum) pump 26 to evacuate both the cleaning chamber 12 and heated solvent vessel 58. In the preferred embodiment, vacuum pump 26 is an oil sealed rotary vane, or rotary piston pump, capable of vacuum levels less than 1 torr. Other air handling pumps such as mechanical dry pumps, or constant displacement, or other conventional pumps can also be used. If solvent is present in heated solvent vessel 58, air can be removed by using a solvent handling vacuum pump 36 by opening valves 76 and 92 and activating the pump 36. The air-solvent vapor mixture passes through a condenser 34, and enters solvent holding tank 38 where condensed solvent is collected. The discharged air passes through check valve 66 and activated carbon filter 28. In the preferred embodiment, vacuum pump 36 is a liquid ring pump sealed with the system processing solvent. The processing solvent is circulated and chilled by heat exchanger 51 by opening valve 92, and activating the circulation pump 16. The heat exchanger can be chilled by outside water, re-circulated water as from a cooling tower or by other conventional cooling methods such as using a refrigerated chiller.

Clean solvent can now be introduced to the heated solvent vessel 58 by activating circulation pump 16 and opening valve 72. Upon filling the heated solvent vessel 58, the solvent in the vessel 58 is heated to the desired operating temperature which is below the solvent's normal Boiling Point (NBP). In the preferred embodiment, an electric heater 40 is used. Also in the preferred embodiment, the cleaning chamber 12 is heated by activating the electric heater 14.

Upon heating the solvent and vessels, a part 20 to be treated can be placed in the decompression chamber 12 on an appropriate holder 22. The chamber 12 is then sealed by closing lid 88 and vent valve 24. Vacuum pump 26 is then activated, valve 30 is opened, and the chamber 12 is evacuated of essentially all the air. Typically, oil sealed pumps can evacuate the chamber to pressures of less than 10 torr and in the preferred embodiment, vacuum levels of 1 torr or less are desired. Upon evacuating to 1 torr, pump 26 is turned off and valve 30 is closed.

To initiate processing, valves 74 and 18 are opened and since the vessels are free of air, the solvent in the heated solvent vessel 58 flashes into the decompression chamber 12 and increases the pressure to near the vapor pressure of the solvent or solution in vessel 58. Upon opening valves 74 and 18 and flashing vapor, the solvent in the heated vessel 58 cools. The solvent is continuously heated by electric heater 40. As indicated above, the solvent in the heated vessel 58 is heated to a temperature below the solvent's normal boiling point (NBP). If the temperature of the vessels 12 and 58, is below the normal boiling point, both vessels will be under negative gauge pressure, the pressure being approximately equal to the vapor pressure of the processing solvent at the operating temperature chosen. The cleaning chamber can operate at temperatures above the NBP of the solvent provided lid 88 is locked in position by locking rings, clamps, or other conventional means (not shown) to provide for adequate sealing. Unlike open top vapor cleaners, the enclosed vacuum vapor decompression system can thus be operated at any desired temperature depending upon the capacity of the electric heaters 14 and 40. Either monitoring the solvent temperature with a temperature-measuring device 84 and/or solvent pressure with a pressure-measuring device 86 can control the on/off cycling of the heaters.

In the basic preferred embodiment, heated liquid solvent can be introduced into the decompression chamber through valve 74 by opening valve 44, closing valve 18 and activating pump 68. Upon filling the chamber 12 to a level which will submerge the part 20, pump 68 is turned off and valves 44 and 74 are closed. In this regard, a level switch 32 is installed within the chamber to automatically detect proper filling level, and turn off pump 68, and close valves 44 and 74. Thereafter, vacuum pump 36 is turned on, valve 50 is opened and vapor is removed from the chamber. Removal of the vapor reduces pressure within the system 10, and since the solvent in the chamber 12 is under vacuum, solvent bubbles will begin to nucleate at the solid surfaces including the surface of the part 20. If the vacuum pump 36 continues to evacuate vapors, the vapor bubbles at the surface will grow, detach from the solid surface and rise to the top of the vessel 12 to replenish the vapor being removed by the vacuum pump 36, thus maintaining the chamber at or around the vapor pressure of the solvent. Such a condition will continually allow replenishment of the surface with fresh solvent at the region where vapor bubbles are detached, i.e. the bubbles create a desired solvent flow over the surface of the part 20. These regions will thus experience a rapid increase in mass and heat transfer to and from this surface area. These regions will also experience rapid increases in the concentration of nonvolatile components in solution if such components are present. The decompression process thus enhances the treatment of the surfaces at these regions.

On the other hand, if valve 50 is closed after pulling a vacuum, the chamber 12 will rapidly return to the original pressure of the chamber 12 and the bubbles at the part surfaces will collapse releasing a large quantity of energy locally at these implosion areas. The release of energy can be used to remove contaminants at the surface as an example. If valve 50 is rapidly cycled on and off, a large quantity of energy can be delivered to a local region for surface processing.

Upon completion of processing object 20, valves 74 and 44 are closed to isolate the decompression chamber 12. Solvent is drained from the processing chamber 12 by opening valves 64 and 18 and activating pump 68. Upon draining chamber 12, valves 64 and 18 are closed and pump 68 is deactivated.

Solvent vapors are now withdrawn from chamber 12 by activating vacuum pump 36 and opening valve 50. The vapors withdrawn are condensed by three mechanisms. The solvent vapors first pass through condenser 34 where most of the vapors exit as liquid. The vapors are next compressed in vacuum pump 36, which condenses additional vapor. In addition, during passage through vacuum pump 36, the vapor-liquid mixture is mixed with chilled solvent, which is circulated to the vacuum pump by circulation pump 16. The solvent is chilled by heat exchanger 51 when valve 92 is opened. The condensed vapors and chilled solvent are returned to holding tank 38 and since all the fluids pumped to the vessel are condensable, the holding tank 38 remains at atmospheric pressure and no solvent vapor is discharged to the environment.

The solvent ring pump 36 preferred on the basic unit 10, if sealed with the processing solvent, is limited to a vacuum pressure which can be attained in chamber 12, depending upon the vapor pressure of the chilled solvent sealing the pump and/or the number of stages of the vacuum pump. In the preferred embodiment, vacuum levels in chamber 12 typically can reach 100 torr or less with a single stage vacuum pump and can reach 10 torr with higher boiling solvents and/or highly chilled solvent with a dual stage vacuum pump 36. At these vacuum pressures any solvent liquid remaining on the processed object 20, on the holder 22, or in the chamber 12 will generally flash into the vapor state and will also be removed from the chamber 12. There generally will remain some residual vapors, which are desirable to recover to prevent solvent emissions prior to opening chamber 12.

To further recover these residual vapors, after reducing chamber 12 to a vacuum pressure approaching vacuum pump 36 limitations, valve 24 is opened thus introducing ambient air to the processing chamber 12. The air-vapor mixture passes from processing chamber 12, through valve 50 and condenser 34 and is returned to holding tank 38 through vacuum pump 36. Initially the pressure in holding tank 38 is increased, however, as air is pumped to the vessel, the pressure will increase until check valve 66 opens at which time the air passes through carbon filter 28 to the environment.

Upon sweeping solvent vapor from chamber 12, valves 50 and 24 are closed and vacuum pump 36 is turned off to again isolate the chamber 12. The concentration of processing solvent vapor within chamber 12 is now low enough so that essentially all of the air-vapor mixture can be removed utilizing the air-handling pump 26. Pump 26 is activated and the residual air-vapor mixture is removed from chamber 12 by opening valve 30. The mixture is pumped to carbon filter 28 through check valve 60 to the environment.

After evacuating chamber 12 of essentially all vapor and air, the chamber is again isolated by closing valve 30. The chamber is then returned to atmospheric pressure by opening valve 24.

If desired, chamber 12 can be evacuated a second time by closing valve 24, opening valve 30, and activating vacuum pump 26 a second time. Air being removed passes through carbon filter 28 prior to discharge to the atmosphere. After pump down, closing valve 30 again isolates chamber 12 and turning off pump 26 returns the chamber to atmospheric pressure when valve 24 is opened. Lid 88 is opened and the part 20 is removed and dried of all solvent.

Example of a Working System

As a working example, a cleaning process will be outlined. In the preferred embodiment, perchloroethylene (PCE) is used as a processing fluid. PCE is well accepted as a good degreasing solvent in open top cleaners. In a preferred process, PCE is heated in an air free heated solvent vessel 58 to 230 degrees Fahrenheit at which the pressure of the vessel will rise approximately to 550 torr, the vapor pressure of PCE at this temperature. After a part or article 20 is placed in the cleaning chamber 12 on an appropriate holder 22 and lid 88 is sealed, valve 24 is closed to isolate the chamber. Pump 26 is activated to evacuate the chamber 12 through open valve 30 and through carbon filter 28.

After evacuating chamber 12 to a vacuum level of 1 torr or less, valve 30 is closed to isolate the chamber 12, and valves 74 and 18 are opened to introduce hot PCE vapors to the chamber 12. Condensed PCE and contaminate removed from the part 20 is returned to the heated solvent tank 58 by opening valve 64. Simultaneously, heat is introduced to the system 10 through electric heater 40 and electric heat jacket 14, respectively, heating both the solvent vessel 58 and cleaning chamber 12 walls up to 230 degrees Fahrenheit. Solvent condensing continues until part 20 reaches temperatures in excess of 225 degrees Fahrenheit at which point pump 68 is activated and valve 74 is opened to introduce solvent to the chamber. After submerging the part 20, valve 74 is closed and pump 68 is turned off. The cycling and removal process continues as described above in the general case.

Contemplated uses of the system include the following:

(1) bubble generation on the parts is utilized to clean or dislodge micron and sub-micron particles or insoluble contaminants from a part's surface;

(2) bubble generation on the parts is utilized to enhance mass transfer to a part's surface such as a corrosion inhibitor dissolved in the solvent being deposited on a solid surface;

(3) bubble generation on the parts is utilized to enhance mass transfer from a part's surface such as dissolving waxes which are being cleaned from the surface;

(4) bubble generation on the part's is used to increase local concentration of chemicals, such as acids, for etching at a solid surface;

(5) filtration of solids from a fluid wherein a filter is mounted in the vacuum chamber and bubble generation is used to transfer solids to the filter surface for removal from the liquid;

(6) regeneration of carbon filters wherein a carbon filter is mounted in the vacuum chamber and bubble generation is used to transfer chemicals from the filter surface for removal of chemicals in order to regenerate the carbon;

(7) for depositing chemicals on a substrate, wherein the solvent is an emulsion, and bubble generation is used to evaporate the liquid carrier fluid adsorbed on the surface and deposit a chemical substrate for treating the solid part's surface; and (8) bubble generation on the part's surface is used to cool the surface in order to enhance a process, such as surface adsorption.

Description of Alternate Embodiment

Referring now to FIG. 2, an alternative solvent and aqueous decompression processing system is illustrated and generally indicated at 10A.

For more intense bubble implosion or more rapid bubble collapsing, a non-condensable gas is introduced into the chamber 12 to more rapidly collapse the vapor bubbles. The arrangement for this type of process is depicted in FIG. 2. During the bubble generation process, valve 50 remains open and vacuum pump 36 remains on. Valve 78 is opened to create a low pressure in chamber 12, which generates vapor bubbles. The valve 78 is then closed and valve 80 is opened to introduce air or another non-condensable gas from holding tank 38 to rapidly increase the pressure in chamber 12. The increasing pressure collapses the vapor bubbles and valve 80 is closed and valve 78 is opened to repeat the cycle. The gases and vapors are pumped from the chamber by vacuum pump 36 through heat exchanger 34 to be cooled and returned to holding tank 38 for recycling.

If the vapor volume produced during decompression and/or if the vessel 12 is so large that a large quantity of non-condensable gas needs to be removed, a surge tank can be used as depicted in FIG. 2. The tank can collect expanding liquid from the processing chamber 12 during bubble generation and can refill the vessel during pressurizing with air. During decompression and vapor bubble generation, valve 50 and 18 are opened as shown in FIG. 2 and vacuum pump 36 is turned on. Liquid expanding in the chamber 12 spills into surge tank 70 to allow unconfined vapor bubble growth in chamber 12. To collapse the bubbles, valve 78 is closed and valve 80 is opened. Non-condensable gases can be introduced from holding tank 38 to pressurize the surge tank 70 and chamber 12 to return liquid from surge tank 70 to chamber 12 and collapse the bubbles. Upon closing valve 80 and opening valve 78, non-condensable gases are removed from surge tank 70 and chamber 12 and bubbles are again generated at the solid surfaces. The gases and vapors removed from surge tank 70 are pumped through the condenser 34 and vacuum pump 36 to be returned to holding tank 38 for recycling. For higher pressure operations and/or greater vacuum/pressure cycle differential pressures, compressor 82 may be used.

For purer solvent recovery and recycling, applying the decompression process to a fibrous filter will enhance filtration. Solvent being recycled to chamber 12 is passed through filter 90 to remove particles from the solvent for further particle removal from part 20. To enhance particle removal, valve 94 may be opened while vacuum pump 36 is on. The filter compartment will then be depressurized and vapor bubbles will be generated at the filter's fibers. The growing bubbles disturb the streamline flow around the external surface of the fibers. Small particles, which normally would follow these flow streams and normally never reach the solid surface to be adsorbed by the fiber, now become exposed to the vapor bubbles at the surface. Upon collapsing these bubbles, the particles are now drawn to the fiber surface to be adsorbed on the fiber and removed from the solvent.

It can therefore be seen that the present invention provides a unique closed solvent and aqueous decompression processing system that is more effective at producing bubble formation and treatment of parts within the system.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of treating an object in a closed solvent processing system, said system including a vacuum chamber, said object being disposed in said vacuum chamber, said system further comprising a solvent supply system in communication with said vacuum chamber, said method comprising the steps of:

isolating said solvent supply system from said vacuum chamber;

reducing pressure within said vacuum chamber to create a vacuum condition within said vacuum chamber;

introducing solvent from said solvent supply system into said vacuum chamber;

alternating pressure and vacuum within said vacuum chamber to cause decompression bubbles to form at a surface of said object, said decompression bubbles treating said object in a desirable manner by generating energy from implosion of said decompression bubbles;

recovering the solvent within the vacuum chamber;

isolating the vacuum chamber from the solvent supply system; and introducing a gas into the vacuum chamber to sweep solvent from said object and from within the vacuum chamber.

2. The method of claim 1 wherein said step of introducing solvent into said vacuum chamber comprises the steps of first introducing solvent vapor into the vacuum chamber until the pressure is near the solvent vapor pressure, and then pumping liquid solvent into the vacuum chamber to immerse the object.

3. The method of claim 2 wherein said step of alternating vacuum and pressure comprises the step of continuously removing said solvent vapor from said vacuum chamber wherein decompression bubbles continuously form at the surface of said object, grow and detach from said surface and rise to the top of the vacuum chamber to replenish the solvent vapor removed therefrom.

4. The method of claim 2 wherein said step of alternating vacuum and pressure causes decompression bubbles to be cyclically formed and collapsed on a solid surface of said object.

5. The method of claim 4 wherein air is introduced into said vacuum chamber to more rapidly collapse said decompression bubbles.

6. The method of claim 1 wherein air and solvent vapors are removed from said vacuum chamber and recycled, and pumped back into the vacuum chamber as a pressurizing medium.

7. The method of claim 2 wherein air and solvent vapors are removed from said vacuum chamber and recycled, and pumped back into the vacuum chamber as a pressurizing medium.

8. The method of claim 3 wherein air and solvent vapors are removed from said vacuum chamber and recycled, and pumped back into the vacuum chamber as a pressurizing medium.

9. The method of claim 4 wherein air and solvent vapors are removed from said vacuum chamber and recycled, and pumped back into the vacuum chamber as a pressurizing medium.

10. The method of claim 1 wherein a corrosion inhibitor is dissolved in the solvent, said decompression bubbles treating said object by depositing said corrosion inhibitor on said surface of said object.

11. The method of claim 1 wherein said object to be treated comprises a filter, having a filter surface and further wherein said solvent includes solid particles suspended therein, said decompression bubbles treating said filter by transferring said solid particles to the filter surface for removal from the solvent.

* * * * *